United States Patent [19]

Ochiai et al.

[11] Patent Number: 4,583,675

[45] Date of Patent: Apr. 22, 1986

[54] METHOD OF PRODUCTION OF A PART FORMED WITH AN OPENING

[75] Inventors: Izumi Ochiai, Tochigi; Katuo Matui, Utsunomiya; Tadaaki Ayabe, Ibaraki, all of Japan

[73] Assignee: Hitachi, Ltd., Tokyo, Japan

[21] Appl. No.: 755,219

[22] Filed: Jul. 15, 1985

Related U.S. Application Data

[63] Continuation of Ser. No. 451,961, Dec. 21, 1982, abandoned.

[30] Foreign Application Priority Data

Dec. 23, 1981 [JP] Japan ..... 56-206946

[51] Int. Cl.[4] ..... B21D 11/08; B21D 53/16; B23K 11/10

[52] U.S. Cl. ..... 228/155; 228/152; 228/173.6; 72/167; 72/168; 72/366; 72/379; 219/91.23

[58] Field of Search ..... 72/167–169, 72/161, 136, 366, 379, 377; 228/152, 155, 173.6; 10/86 B; 29/159 R, 159.1, 156.8 R; 219/91.23, 59.1, 78.16

[56] References Cited

U.S. PATENT DOCUMENTS

| | | | |
|---|---|---|---|
| 1,032,718 | 7/1912 | White | 228/155 |
| 1,158,294 | 10/1915 | Robinson | 72/167 |
| 1,887,342 | 11/1932 | Vickerman | 228/170 |
| 2,365,882 | 12/1944 | Kane | 72/167 |
| 3,266,280 | 8/1966 | Wiig | 72/161 |
| 3,461,702 | 8/1969 | Wallace et al. | 72/161 |
| 3,704,616 | 12/1972 | Taira | 72/167 |
| 3,921,432 | 11/1975 | Rivers | 72/167 |

FOREIGN PATENT DOCUMENTS

| | | | |
|---|---|---|---|
| 493472 | 3/1930 | Fed. Rep. of Germany | 29/159 R |
| 2557564 | 6/1977 | Fed. Rep. of Germany | 72/379 |
| 305179 | 1/1933 | Italy | 29/159.01 |
| 136931 | 8/1979 | Japan | 72/167 |
| 307706 | 12/1929 | United Kingdom | 72/167 |
| 624169 | 5/1949 | United Kingdom | 72/167 |

*Primary Examiner*—Daniel C. Crane

*Attorney, Agent, or Firm*—Antonelli, Terry & Wands

[57] ABSTRACT

A method of production of a part formed with an opening wherein a metal strip material is subjected to rolling at its outer peripheral portion to have its thickness slightly reduced and shape the metal strip material into a ring-shaped blank, and at least one of inner and outer peripheral portions of the ring-shaped blank is drawn by a press to form at least one flange. The metal strip is supported in coil form on an uncoiler and payed out therefrom and subjected to a straightening before being subjected to rolling. When the metal strip material is rolled, its inner side is wrinkled. The ring-shaped blank is cut and a projection is formed at one end portion and superposed on the other end portion to be joined by electric spot welding to provide a completed ring-shaped blank. When the blank is drawn to form the flanges, by virtue of the wrinkles and thinned outer peripheral portion, the thickness of the part becomes substantially uniform.

3 Claims, 7 Drawing Figures

METHOD OF PRODUCTION OF A PART FORMED WITH AN OPENING

This application is a continuation of application Ser. No. 451,961, filed 12/21/82, now abandoned.

FIELD OF THE INVENTION

This invention relates to a method of production of a part formed with an opening, such as a part of a fluid machine used as a fluid outlet port or a part of a fan serving as a mouth ring.

BACKGROUND OF THE INVENTION

As shown in FIGS. 1 and 2 in a prior art method a flat ring blank 2 is produced by punching a rectangular metal sheet 1 by a press. Then a part 3 formed with an opening 7 is produced by stretching the flange inwardly of the ring material 2 as indicated at 3*a* and shrink flanging outwardly thereof as indicated at 3*b* by a press.

In the method of production of the prior art, portions of the material or rectangular metal material 1 corresponding to four corners 4 and a portion 5 corresponding to the opening 7 are scrapped as waste material. Thus, the material has a very low yield and a large portion thereof is discarded as waste material. When the part 3 is formed by drawing, the stretch flange 3*a* has its thickness reduced in going from its base toward its end, thereby causing a reduction in strength. Meanwhile the shrink flange 3*b* has its thickness increased in going from its base toward its end, thereby causing an increase in weight.

SUMMARY OF THE INVENTION

This invention has as its object the provision of a method of production of a part formed with an opening capable of producing such part by minimizing waste of the material while imparting a uniform thickness to the part.

The outstanding characteristic of the invention enabling the aforesaid object to be accomplished is that a metal strip material has its outer peripheral portion rolled to have its thickness slightly reduced to wind the metal strip into a ring-shaped blank, and a flange is formed by drawing at least one of outer and inner peripheral portions of the ring-shaped blank.

DESCRIPTION OF THE PREFERRED EMBODIMENT

Figure 1:
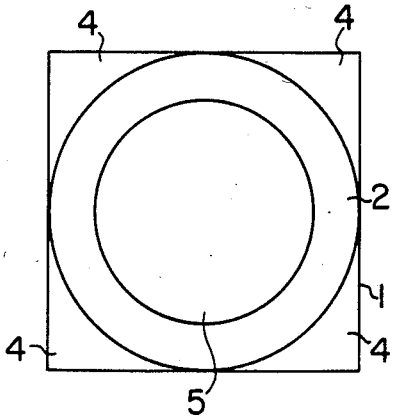
FIG. 1 is a plan view of a ring blank produced by punching by a method of the prior art for producing a part formed with an opening.
Figure 2:
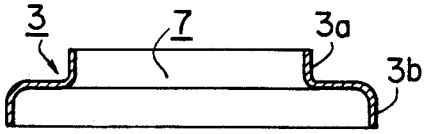
FIG. 2 is a sectional view of a part formed with an opening produced as a completed article by the method of the prior art.
Figure 3:
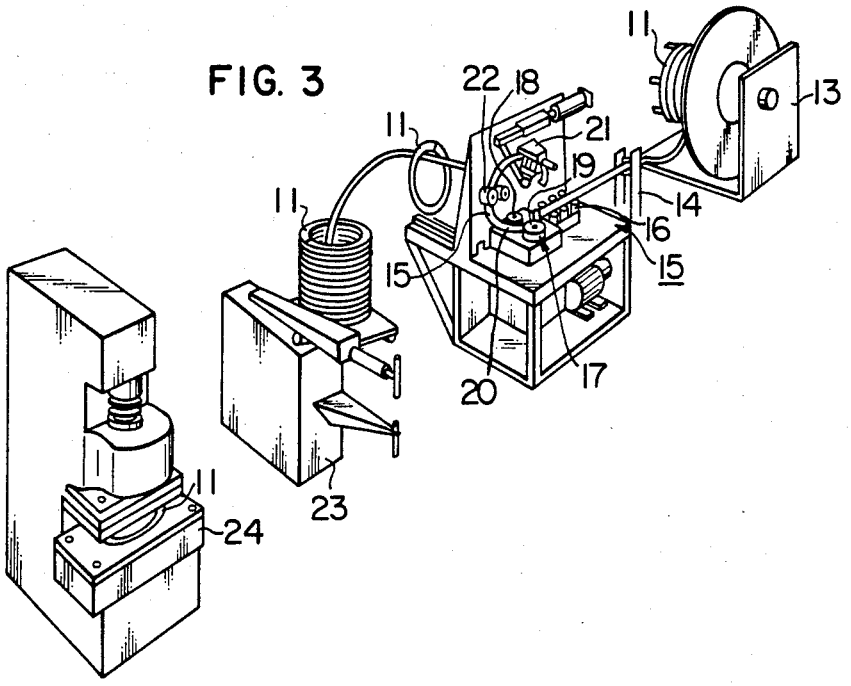
FIG. 3 is a perspective view of an apparatus suitable for carrying into practice the method of production of a part formed with an opening comprising one embodiment of the invention.
Figure 4:
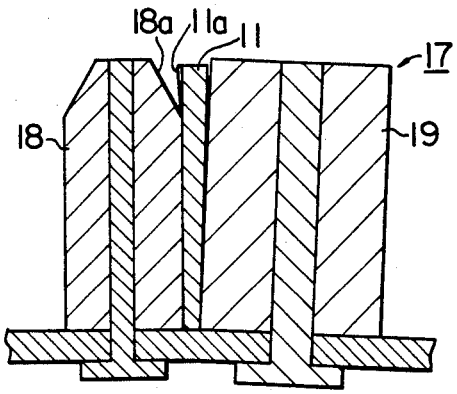
FIG. 4 is a sectional view of the material used for producing a part formed with an opening by the method of the invention being subjected to rolling by the apparatus shown in FIG. 3.

Referring now to the drawings wherein like reference numerals are used throughout the various views to designate like parts and, more particularly, to FIGS. 3–6, according to these figures, a metal strip material 11, such as steel, aluminum, etc., having a width large enough to form a ring-shaped blank is wound in coil form and supported on an uncoiler 13. The metal strip material 11 is payed out of the uncoiler 13 and fed through a loop control means 14 to a roll bending machine 15 where it is rendered straight by a leveler 16 before reaching roll means 17 for effecting rolling. The roll means 17 comprises, as shown in FIG. 4, a rolling roll 18 of minor diameter supported in a vertical position, and a rolling roll 19 of major diameter supported in an inclined position, with the rolling roll 18 of minor diameter being formed with an inclined cutout 18*a* in its upper portion. The rolling rolls 18 and 19 of minor and major diameters are spaced apart from each other by a gap of a dimension such that the gap is smaller at its lower end than the thickness of the metal strip material 11, substantially equal thereto at a starting point of the cutout 18*a*, and larger in the cutout 18*a*. The metal strip material 11 is rolled in such a manner that a lower end of a portion below the cutout 18*a* of the rolling roll 18 is minimized in thickness and the thickness increases in going upwardly from the lower end with the metal strip material 11 being automatically bent inwardly and shaped into a ring-shaped blank.

Figure 5:
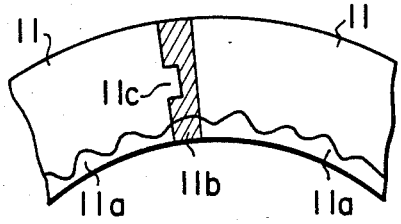
FIG. 5 is a fragmentary plan view of the material used for producing a part formed with an opening by the method according to the invention being subjected to cutting.
Figure 6:
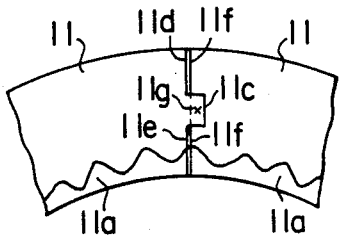
FIG. 6 is a fragmentary plan view of the material used for producing a part formed with an opening by the method according to the invention being subjected to welding by electric spot welding.
Figure 7:
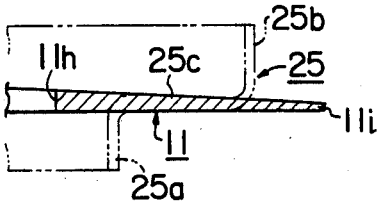
FIG. 7 is a sectional view in explanation of the operation of forming flanges in the ring-shaped blank formed of the material shown in FIGS. 4, 5 and 6 by the method according to the invention.

A portion of the metal strip material 11 corresponding to the cutout 18*a* of the rolling roll 18 becomes wrinkled as indicated at 11*a*. The amount of a bend formed in the metal strip material 11 may vary in dependence upon the manner in which the strip 11 is deformed in a thickness direction, but the amount shows variations of a large value when the initial thickness of the strip 11 is not uniform. This makes it necessary to provide a guide 20 of a predetermined arcuate shape at the outlet of the roll means 17 to effect adjustments. The metal strip material 11 bent into a ring-shaped blank is fed to cutting means 21. An encoder 22, for converting a signal representing a number of revolutions to a signal representing a length, is located anterior to the cutting means 21 in contact with an outer peripheral surface of the strip material for measuring the circumferential length of the strip material 11 that has been fed. When the metal strip material 11 has been fed for a length large enough to form the ring-shaped blank, the encoder 22 supplies a signal to the cutting means 21 to cut the metal strip material 11. When cutting of the metal strip material 11 is effected, the strip 11 is stamped to remove a small portion 11*b* (hatched portion) to be discarded as a scrap, as shown in FIG. 5. At this time, a projection 11*c* for welding is formed at one end portion of the severed strip 11. Then the projection 11*c* is joined by an electric spot welding machine 23 shown in FIG. 3 to the other end portion in such a manner that, as shown in FIG. 6, the projection 11*c* alone is superposed on the other end portion and end face portions 11*d* and 11*e* except for the end face of the projection 11*c* are abutted against the end face 11*f* of the other end portion. The spot welding is shown in FIG. 6 at 11*g*. Thereafter the ring-shaped blank is drawn by means of a press 24 shown in FIG. 3 to form a stretch flange 25*a* on its inner side 11*h* and a shrink flange 25*b* on its outer side 11*i* indicated by phantom lines, to provide an article 25 as shown in FIG. 7. The stretch flange 25*a* is formed by removing the wrinkle 11*a* of the blank 11 and elongating the material of the blank 11, so that the thickness of the article 25 becomes unified and all the portions thereof become equal in thickness to its central portion 25*c*. The shrink flange 25*b* is formed while the material itself is compressed to have its thickness increased to a value equal to that of the central portion 25*c*.

By the method of production of a part formed with an opening described hereinabove, the metal strip material 11 is formed into a ring-shaped blank by rolling the output peripheral portion of the strip 11 in a manner to reduce its thickness slightly, and at least one of the inner and outer peripheral portions of the ring-shaped blank is drawn to form flanges 25*a* and 25*b*. Thus, almost all the material of the metal strip material 11 can be utilized to provide the article 25 formed with an opening. The method according to the invention enables a part formed with an opening to be produced without wasting the material and makes it possible to economize on material cost. The article 25 formed with an opening according to the invention is free from the defect of being low in strength or heavy in weight because the flanges 25*a* and 25*b* have the same thickness as the central portion 25*c* of the article 25.

The metal strip material 11 is wound in coil form on the uncoiler 13 and has loops removed by the loop control means 14 and straightened by the leveler 16 before being rolled. This makes it possible to produce the article 25 formed with an opening continuously and automatically on a mass production basis.

When the metal strip material 11 has its outer peripheral portion rolled and has its thickness slightly reduced by rolling to provide a ring-shaped blank, the wrinkle 11*a* on the inner side of the strip material 11 is removed while the inner peripheral surface is drawn by means of a press to form the stretch flange 25*a*. This makes it possible to render the thickness of the stretch flange 25*a* equal to that of the central portion 25*c* of the article 25.

When the ring-shaped blank formed from the metal strip material 11 is cut, the projection 11*c* for welding is formed at one end portion of the ring-shaped blank and superposed on the other end portion of the blank and the overlapping is subjected to welding by electric spot welding before the flanges 25*a* and 25*b* are formed by drawing. This enables improved dimensional accuracy to be obtained.

The meritorious effects achieved by the invention include the following. The method according to the invention enables almost all the material of the metal strip material 11 to be utilized in producing the article 25 formed with an opening. Thus, waste of the material can be minimized, making it possible to economize on material cost. Since the article 25 has a uniform thickness, the article 25 is free from the defects of low strength or heavy weight.

What is claimed is:

1. A method of production of a part formed with an opening, the method comprising the steps of:

providing a straight metal strip material having longitudinal edges, leading and trailing ends;

subjecting said metal strip material to rolling to slightly reduce its thickness along one longitudinal edge causing said strip to be shaped into a ring-shaped blank having an outer peripheral portion and an inner side defining an opening;

wrinkling said inner side of the metal strip material by guiding the ring-shaped blank along an arcuate guide when the metal strip material is subjected to rolling at its one longitudinal edge to have a thickness thereof slightly reduced;

connecting said ends to one another; and drawing said inner side portion of said ring-shaped blank to form a flange and remove the inner side wrinkling.

2. A method of production of a part formed with an opening as claimed in claim 1, further comprising the step of paying the metal strip material out of an uncoiler supporting said metal strip, removing loops from said metal strip material and rendering the metal strip material straight by a leveler before subjecting the metal strip material to rolling.

3. A method of production of a part formed with an opening as claimed in claim 1, further comprising the step of cutting said ring-shaped blank and forming a projection at one end portion of the cut ring-shaped blank after the metal strip material is shaped into the ring-shaped blank, and superposing the projection over the other end portion of the cut ring-shaped blank to join them by electric spot welding before at least one flange is formed by drawing.

* * * * *